United States Patent [19]

Hegedüs et al.

[11] Patent Number: 4,641,834

[45] Date of Patent: Feb. 10, 1987

[54] TRAINING APPARATUS FOR KICKING A FOOTBALL

[76] Inventors: László Hegedüs, Tátra tre,acu/e/ r A/2, 1025 Budapest; Zoltán Horváth, Váci ut 79, 1056 Budapest, both of Hungary

[21] Appl. No.: 721,520

[22] Filed: Apr. 9, 1985

[30] Foreign Application Priority Data

Apr. 27, 1984 [HU] Hungary ..... 1649/84

[51] Int. Cl.[4] ..... A63B 69/00; A63B 67/00

[52] U.S. Cl. ..... 272/76; 273/411; 273/55 R

[58] Field of Search ..... 272/76–78, 272/136, 137, 141; 273/411, 55 R, 55 A, 55 B

[56] References Cited

U.S. PATENT DOCUMENTS

| | | | |
|---|---|---|---|
| 2,840,948 | 7/1958 | Stickley | 272/78 |
| 3,427,021 | 2/1969 | Donato | 273/55 R |
| 4,440,400 | 4/1984 | Neuberger | 272/76 |
| 4,480,832 | 11/1984 | Bulmash et al. | 272/137 |
| 4,516,769 | 5/1985 | Kopp | 273/411 |

FOREIGN PATENT DOCUMENTS

| | | | |
|---|---|---|---|
| 2337563 | 9/1977 | France | 273/55 R |
| 429823 | 11/1974 | U.S.S.R. | 272/76 |
| 0774566 | 10/1980 | U.S.S.R. | 272/76 |

*Primary Examiner*—Richard J. Apley
*Assistant Examiner*—S. R. Crow
*Attorney, Agent, or Firm*—Gabriel P. Katona

[57] ABSTRACT

The subject of the invention is an apparatus set up on a small area and at any place, thus in the home too, which is suitable for the development of both leg muscles and for the intensification of the kicking force. The apparatus consists of a ball-holding basket capable to move in the direction of kicking and upon completion of the kicking to return it quickly to its initial position. The apparatus may include such adjusting unit, whereby the load applied to the leg is controllable. The apparatus can be set up on the ground or fixed to a wall.

5 Claims, 1 Drawing Figure

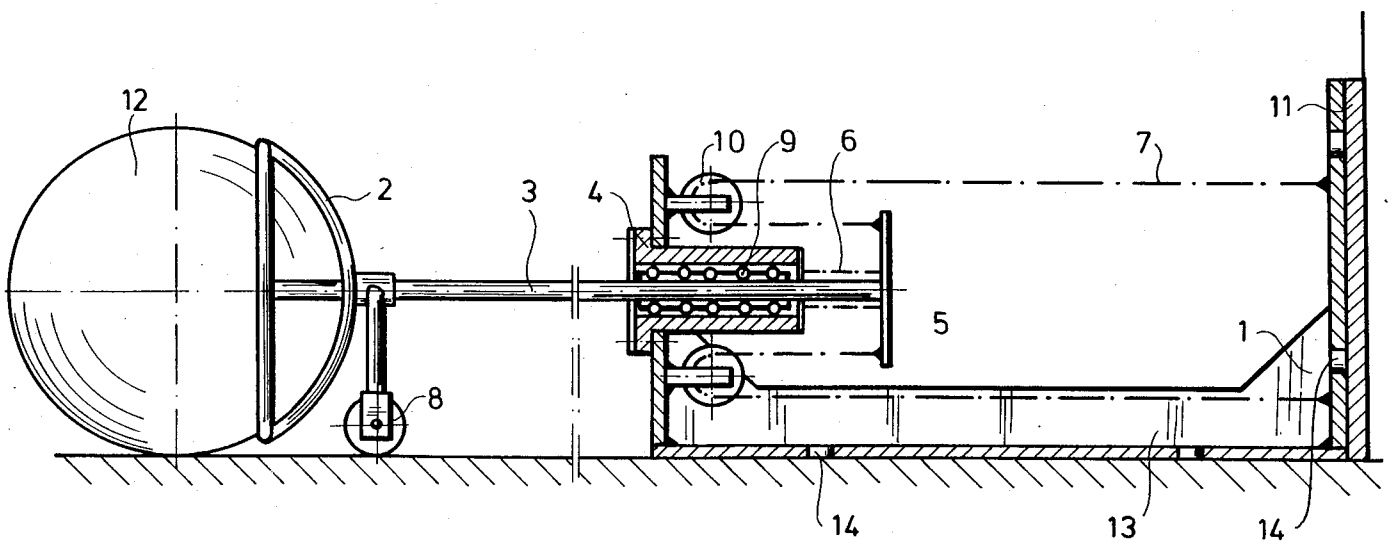
11
1
14
7
13
5
6
14
9
10
4
3
8
2
12

TRAINING APPARATUS FOR KICKING A FOOTBALL

BACKGROUND

The subject of the invention is an apparatus for developing the leg muscles and intensification of the kicking force applicable for non-professional sportsmen/-women and for the self-training of football players.

The exercises aimed at intensification of the kicking force have already been used in the training of football players, but these were carried out with ball put on the ground and then kicked away, or with static devices, e.g. weight lifting with leg.

The greatest drawback of the first method is that the kicked away balls have to be returned to the original spot and positioned again. This is time-consuming—even if bouncing wall is used—or it assumes the participation of another person during the training and thus the efficiency is diminished, on the other hand the space requirement of the bouncing wall is large and not applicable within the confines of the home.

The drawback of the second method is in the statics of the effort, thus not exactly the same muscle groups are loaded during the training, which are necessary for kicking away the ball during a match.

The purpose of the invention is to develop such force-intensifying device, which strengthens the muscles used under match conditions and at the same time it returns the ball to the same spot. Furthermore it should allow the realization of these on an area not over 1 $m^2$ and be suitable to set it up at any place.

SUMMARY OF INVENTION

The problem was solved according to the invention with an apparatus which is provided with a ball-holding basket capable to move in the direction of kicking and returning to its initial position with the aid of a spring tensioned by the kicking force. The apparatus preferably consists of a horizontally moving bar guided in a bearing block fixed to a support where the ball-holding basket is fixed to one end of the bar, while a carrier plate is fastened to the other end, and an elastic element is arranged between the support and the carrier plate. The elastic element may be at least two rubber cords tautened between the support and the carrier plate which are guided through worm wheels pulley or a coil spring, one end of which is fastened to the support and the other end to the carrier plate. The apparatus is provided with a ball sleeve for guiding of the bar, which absorbs the spatial force arising from the kicking. Preferably a spring is arranged between the carrier plate and the bearing block which prevents the resounding impact of the carrier plate upon the rear surface of the bearing block. Suitably the support is reinforced with ribs.

The apparatus can be set up on the ground, in this case holes are drilled into the base to fix the whole apparatus to poles or tubes driven into the ground in advance. Various brackets and similar elements can also be used for fastening to the ground.

The apparatus according to the invention can be fixed to an already existing wall too, e.g. for the purpose of trainings in drill halls or at home. In this case the apparatus is fixed by its rear vertical wall with holes drilled in advance. It is advisable to put a thick rubber sheet between the bearing surface of the apparatus and the wall to achieve more favourable pressure upon the wall.

An adjusting device can be used between the support and the elastic elements, whereby the prestressing of the elastic elements is adjustable and the load applied to the leg is controllable.

The apparatus may be provided with a recording unit for recording the number of kicks.

BRIEF DESCRIPTION OF DRAWING

The invention is described in detail by way of example only with the aid of drawing showing the side view partly in section of the apparatus according to the invention.

DETAILED DESCRIPTION

An adjustable bearing block 4 is fixed to a support 1 in which a horizontally moving bar 3 is arranged. A ball sleeve 9 ensures the horizontal movement and guiding of the bar 3. This ball sleeve 9 through the required small bearing clearance allow the free movement of the bar 3 and absorbs the spatial forces applied to the apparatus.

A ball-holding basket 2 consisting of a ring connected to a curved holder corresponding to the shape of the ball is mounted onto one end of the bar 3. A football 12 of standard size 5 is placed into the ball-holding basket 2. The diameter of the ring of the ball-holding basket 2 is such that the ball 12 is pressed in by the kicking. For finer movement a wheel 8 or roller is used to support the ball-holding basket 2.

A carrier plate 5 is fixed to the end of bar 3 facing the support 1. At least two elastic elements 7 are arranged between the carrier plate 5 and the support 1. The elastic elements 7 may be rubber cords, a coil spring or any other mechanical, pneumatic or hydraulic structural element capable to exert restoring force or pulling force. In the given example the elastic elements 7 are two or three rubber cords, one ends of which are fixed to the carrier plate 5 the other ends to the support 1. The rubber cords are led through worm wheels 10 fastened to the support 1. The symmetrically arranged rubber cords 7 prevent the axial displacement of the bar 3. An adjusting device can be arranged between the rubber cords 7 and the support 1 whereby the prestressing of the rubber cords 7 is adjustable.

Spring 6 is arranged on the bar 3 between the bearing block 4 and the carrier plate 5 for braking the bar 3 pulled back by the elastic elements 7.

The support 1 is provided with ribs 13 for adequate stability.

Holes 14 are drilled into the support 1 for fixing to the ground or wall.

The apparatus functions as follows:

The ball 12 is placed into the ball-holding basket 2. The practising player puts his supporting leg to the ball and kicks the ball with the leg to be strengthened. The kicked ball 12 tensions the rubber cords 7 through the bar 3, whereby load is applied to the muscles of the leg used during match. Upon withdrawal of the kicking leg the tensioned rubber cords 7 pull back the ball-holding basket 2 and the ball 12 within to its initial position. The pull back in end position is braked by the spring 6 and the resounding impact of the carrier plate 5 upon the rear surface of the bearing block 4 is prevented.

When the ball 12 is in its initial position, the movement can be repeated. In order to achieve the desired effect the kicks have to be continued over a long time.

The elastic element 7 can be prestressed with the adjusting device, whereby the load applied to the kicking leg is controllable.

The apparatus may be provided with a recording unit for recording the number of kicks.

The apparatus according to the invention can be used for self-training of football players or for non-professional sportsmen/women as well.

The advantage of the apparatus according to the invention is that it developes the muscular system of both legs and it strengthens particularly the muscles used under match conditions, as well as it ensures the fast return of the ball to the same spot. A further advantage is that it can be set up in a small space not over 1 $m^2$, thus it can be used in the home.

A further advantage of the apparatus is that its construction is very simple, the load applied to the leg is easily adjustable, and its erection and use do not require special mounting. In comparison with the bouncing wall, its small space requirement and extremely good utilization of the time represent additional beneficial features.

What we claim is:

1. Apparatus for the development of leg muscles and intensification of the kicking force, comprising a basket for holding a ball therein, an axially movable horizontal bar attached at one end to said basket and to a horizontally movable support adjacent to said basket, a carrier plate attached to the other end of said horizontal bar, a ball sleeve in a bearing box, the horizontal bar being movably positioned through said bearing box, support means for fixing said bearing box, and at least two prestressed elastic elements each having two ends, said elements being attached to said carrier plate at one end of each element, and the other end of each element being attached to a first fixed support, a pulley associated with each element, a second fixed support for each pulley, each pulley being attached to said second fixed support, whereby, when a kicking force is applied to a ball in said basket, said basket and attached horizontal bar are displaced horizontally causing said prestressed elastic elements to stretch then return to their original position moving the basket and horizontal bar to their respective original positions.

2. The apparatus of claim 1 wherein a spring is attached between the bearing block and the carrier plate so as to brake the return movement of the bar after said bar is displaced by a kicking force and is being pulled back to its original position by said prestressed elastic element.

3. Apparatus according to claim 2 in which said prestressed elastic element is a coil spring one end of which is fastened to the support and the other to the carrier plate.

4. Apparatus according to claim 1 in which support is provided with reinforcing ribs.

5. Apparatus according to claim 1 in which holes are drilled into the support for fixing it to a wall or to the ground.

* * * * *